US005201526A

United States Patent [19]

Ketcham, Jr.

[11] Patent Number: 5,201,526

[45] Date of Patent: Apr. 13, 1993

[54] OUTDOOR LAWN-TYPE GAME

[76] Inventor: F. Burk Ketcham, Jr., 29 Fernway, Cohasset, Mass. 02025

[21] Appl. No.: 928,477

[22] Filed: Aug. 13, 1992

[51] Int. Cl.[5] ..... G09B 67/00

[52] U.S. Cl. ..... 273/342; 124/5

[58] Field of Search ..... 273/342, 340, 341, 327, 273/411, 412, 424, 425, 428; 124/5; 282/29

[56] References Cited

U.S. PATENT DOCUMENTS

| | | | |
|---|---|---|---|
| 810,224 | 1/1906 | Sackett | 273/428 X |
| 810,352 | 1/1906 | Sackett | 273/424 |
| 2,944,816 | 7/1960 | Dixon | 273/395 X |
| 3,368,814 | 2/1968 | Kolwicz | 273/342 |
| 3,837,643 | 9/1974 | Lee | 482/29 |
| 3,871,651 | 3/1975 | Garcia et al. | 273/428 |
| 3,994,498 | 11/1976 | Breslow et al. | 273/340 |
| 4,076,004 | 2/1978 | Huelskamp | 124/5 |
| 4,113,252 | 9/1978 | Darby | 273/342 |
| 4,805,916 | 2/1989 | Zentner, Jr. | 273/411 X |
| 4,819,947 | 4/1989 | Mackey | 273/412 |

*Primary Examiner*—William H. Grieb

[57] ABSTRACT

An outdoor lawn-type game for two or more players in which discs are flipped from the ground onto a trampoline device comprised of a resiliently-tensioned net held in a horizontal position by a frame with legs. The discs are flipped using elongated flipping sticks with two bent fork tines at one end. The objective of the game, in getting a specified number of a players' or teams' discs to rest on the net, is rendered difficult by the resilient nature of the net and various options allowed by the rules of the game to dislodge an opponent's disc from the net or send an opponents disc to a point distant from the net. Various competitive strategies and skills are required by the individuals and/or the teams playing the game. No special ground surface is required. The game may be played on grass, in the woods or on the beach.

3 Claims, 4 Drawing Sheets

OUTDOOR LAWN-TYPE GAME

BACKGROUND OF THE INVENTION

1. Field of the Invention

This invention relates generally to games and more particularly to a novel lawn-type game intended to be played by a plurality of individuals of the same or a variety of ages the objective of which is to flip and position a prescribed number of discs onto the resiliently-tensioned net surface of a trampoline device, the net being held in a horizontal position approximately two feet above the ground. The discs are flipped into the air using elongated flipping sticks with two-tined bent forks at one end. The resilient action of the net, as well as the actions of opposing players, in accordance with the rules of the game, renders positioning or maintaining the positioning difficult. No special ground surface is required. The game may be played on grass, in the woods or on the beach.

2. Prior Art

Although the majority of American families and households now live in suburban or rural areas where they have convenient access to outdoor areas, there are a limited number of games of the lawn-type available. Several of the most popular are as follows: croquet which requires a fairly smooth lawn surface and can be played by all age groups; volley ball (also categorized as a sport) which tends to be strenuous, requires a set number of players and is less adaptable to mixed age groups; badminton (also categorized as a sport) which can be played by either two of four players of different ages; and horseshoes which is limited to two or four players. All of the above, with the exception of croquet, tend to damage lawn or ground surface areas with repeated playing.

Reference is made to the following patents which incorporate some of the features presented in this invention but do not combine them in the novel manner proposed herein:

U.S. Pat. No. 3,871,651 to Garcia et. al. is for a penny stick game where a batting stick is used to hit a rod like playing stick sitting on a table. The game tends to be played more like baseball and the only similarity to the present invention is that a stick is used to propel a playing device into the air.

U.S. Pat. No. 3,837,643 to Lee is for a trampoline device game where individuals jump on the trampoline device and are projected upwards towards a mat with points being awarded for the longest jump. The only similarity to the present invention is the use of a trampoline device.

U.S. Pat. No. 2,944,816 to Dixon is a recreational apparatus, not a game, wherein objects such as a ball are thrown at a resiliently-mounted net with the purpose of having the objects rebound in the direction from which they are thrown. The only similarity to the present invention is the use of a resiliently-mounted net.

U.S. Pat. No. 3,368,814 to Kolwicz is a target game wherein a ball or projectile is thrown at a resiliently mounted playing surface disposed in angular relationship to the horizontal such that the ball or projectile is lofted by secondary propulsion from the resiliently mounted playing surface towards a target. The objective is to have balls or projectiles bounce off rather than rest on the resiliently mounted playing surface. The only similarity to the present invention is the use of a resiliently mounted playing surface.

U.S. Pat. No. 4,113,252 to Darby is a rebounding game wherein balls rebound in different and unpredictable directions after hitting overhead bars above the heads of the players. The only similarity to the present invention is the unpredictable rebounding which occurs.

U.S. Pat. No. 3,994,498 to Breslow et. al. is a game apparatus wherein balls resting in a frame structure are struck from below by a hand-held propelling implement to position the balls in circular apertures arranged in a predetermined pattern. The only similarity to the present invention is the provision for having an object hit by a hand-held impelling implement.

Whatever the precise merits, features and advantages of the above-cited references, none of them achieves or fulfills the purpose of establishing a horizontally and resiliently mounted net as the target for objects flipped from the ground using a flipping stick, all of which, in combination, create an outdoor game incorporating the following characteristics: suitability for play by families and unrelated individuals of all ages and not requiring a special playing surface and calling for a test of skills and strategies and embodying "love of play" motivations such as excitement, anticipation, surprise and reward. No device or combination of devices is known which achieves the purposes described in the preceding sentence.

The proposed invention will fill a need for a greater variety of outdoor lawn-type games.

SUMMARY OF INVENTION

The present invention recognizes the popularity of lawn-type games and the deficiencies and advantages of presently available lawn-type games; provides a novel solution in the form of an outdoor lawn-type game not requiring a special playing surface and not destructive to said playing surface; provides a game which can be played by families and/or unrelated individuals of various ages, and provides a game satisfying our innate "love of play" and the various psychological and intellectual factors implicit in game-playing.

A feature of the present invention is the fun, skill and strategy embodied in flipping discs so that they remain positioned on a horizontally mounted resiliently-tensioned net, the flipping being accomplished using elongated flipping sticks with two bent fork tines at one end, and the positioning being rendered difficult by the resilient nature of the net and allowable game options for players to dislodge an opponent's disc from the net or flip opponent's discs to a point distant from the net.

A further feature of the present invention provides a game apparatus which is relatively simple in its construction and which therefore may be readily manufactured at relatively low cost by simple manufacturing methods.

A further feature of the present invention provides a game apparatus which can be readily assembled and disassembled and is of a lightweight construction so that it is portable and thus may be transported easily for use in different areas.

Other features and advantages of the present invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
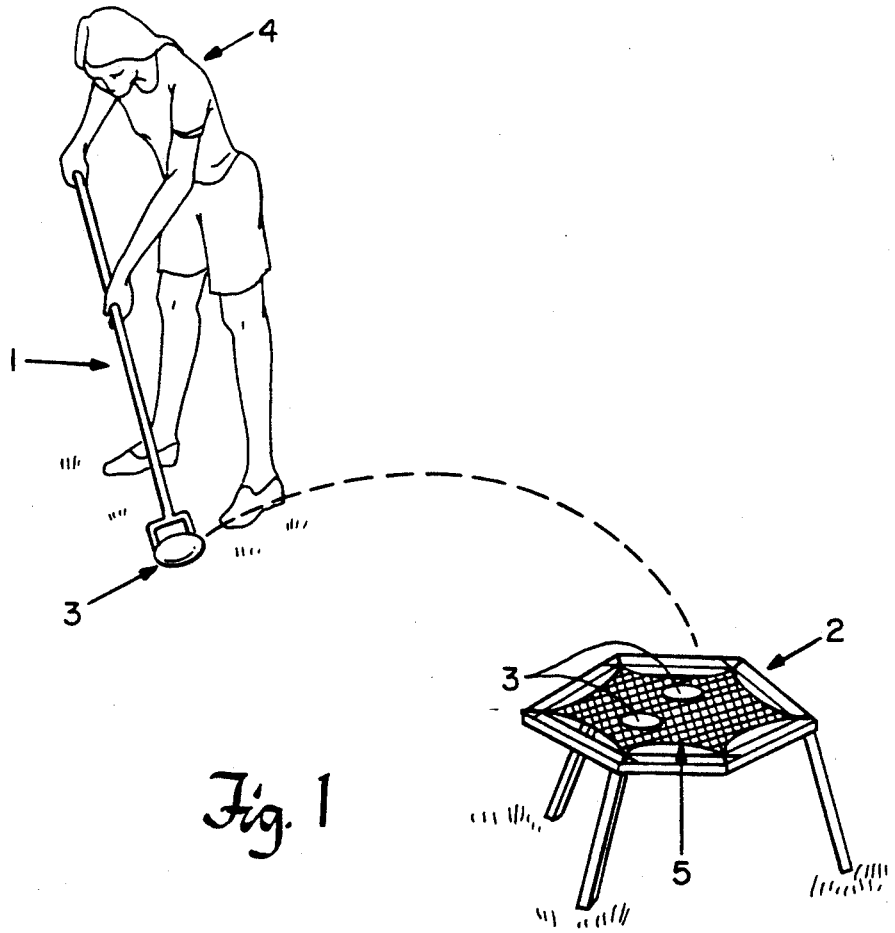
FIG. 1 is a perspective view of the game apparatus of the present invention illustrated in use by one of the players of the game showing the trampoline device, discs and a flipping stick.

Referring now to the drawings in detail there is illustrated a preferred form of game apparatus constructed in accordance with the principles of the present invention and which is comprised of a plurality of flipping sticks, a plurality of discs and a trampoline device comprised of a resiliently-tensioned net held in a horizontal position on a frame supported by three legs and, where necessary on sloping land, a leg extension.

FIG. 1 shows a flipping stick 1, the trampoline device 2, several discs 3 and a player 4 in position to flip a disc 3 onto the resiliently-tensioned net 5 of the trampoline device 2 with a flipping stick 1. Flipping of a disc 3 by a player 4 using the flipping stick 1 is accomplished by pushing down on the player's 4 upper arm, positioned near the top end of the flipping stick 1, and using the player's 4 lower arm, positioned near the center of the flipping stick 1, as a fulcrum to flip a disc 3 into the air.

Figure 2:
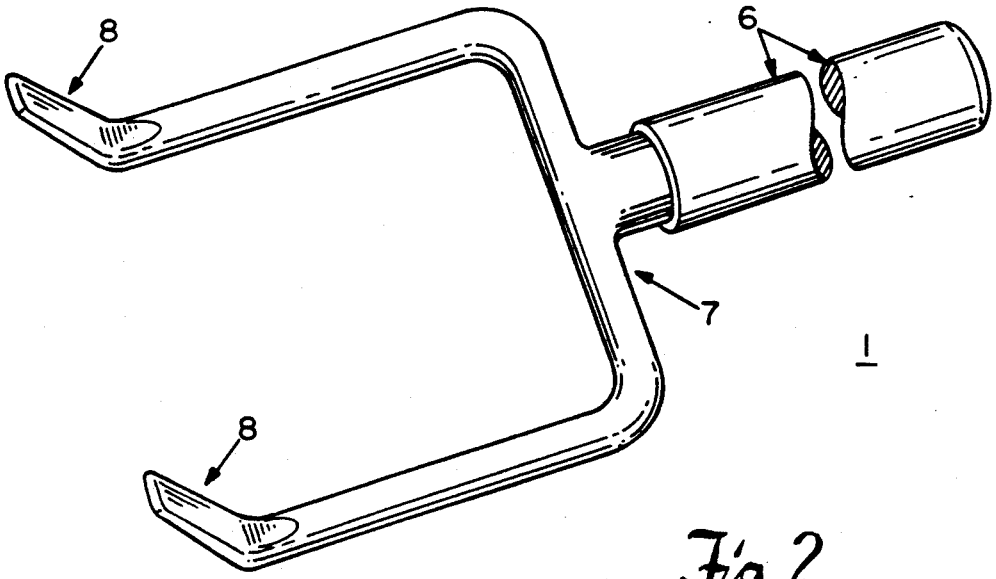
FIG. 2 is a perspective view of one of the flipping sticks.

A flipping stick 1, as shown in FIG. 2, is comprised of an elongated handle portion 6 approximately ¾" in diameter and 4' in length and a two-tined fork 7 portion approximately ⅜" in diameter and 4" in length affixed to one end of the handle portion 6. The tines 8 of the two-tined fork 7 are at a distance of approximately 3" from each other which is a distance slightly less than the outside diameter of the disc 3 and the tines 8 are bent near their outer ends at an angle of approximately 45° so that a player 4 may position the two-tined fork 7 under a disc 3 where it rests on the ground prior to initiating the flipping action which propels the disc into the air. The handle portion 6 may be of solid or hollow construction and may be manufactured out of wood, metal, plastic or any other suitable satisfactory material. The affixed two-tined fork 7 may be of solid construction and may be manufactured out of metal, plastic or any other suitable satisfactory material. A plurality of flipping sticks 1 are coded as by color to the different players of the game.

Figure 3:
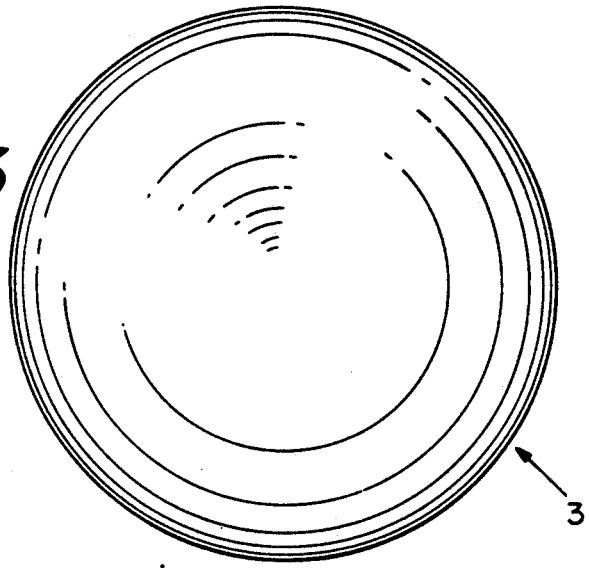
FIG. 3 is a top plan view of one of the discs.
Figure 4:
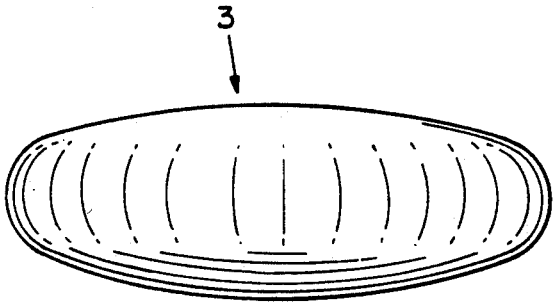
FIG. 4 is a side view of one of the discs.

A disc 3, as shown in FIG. 3 and 4, has a flying saucer configuration with a diameter of approximately 4½" on the circular side and a depth of about 1¼" on the flat side at the center of the circle with the flat side tapering to form a rounded edge at the circumference of the circle. The diameter of a disc 3 is slightly greater than the distance between the two tines 8 of the two-tined fork 7 of the flipping stick 1 so that a disc 3 rests in the two-tined fork 7 during the initial flip of the flipping stick 1. A disc 3 may be manufactured out of wood, plastic, hard rubber or any other suitable satisfactory material. A plurality of discs 3 are coded as by color to the different players of the game.

Figure 5:
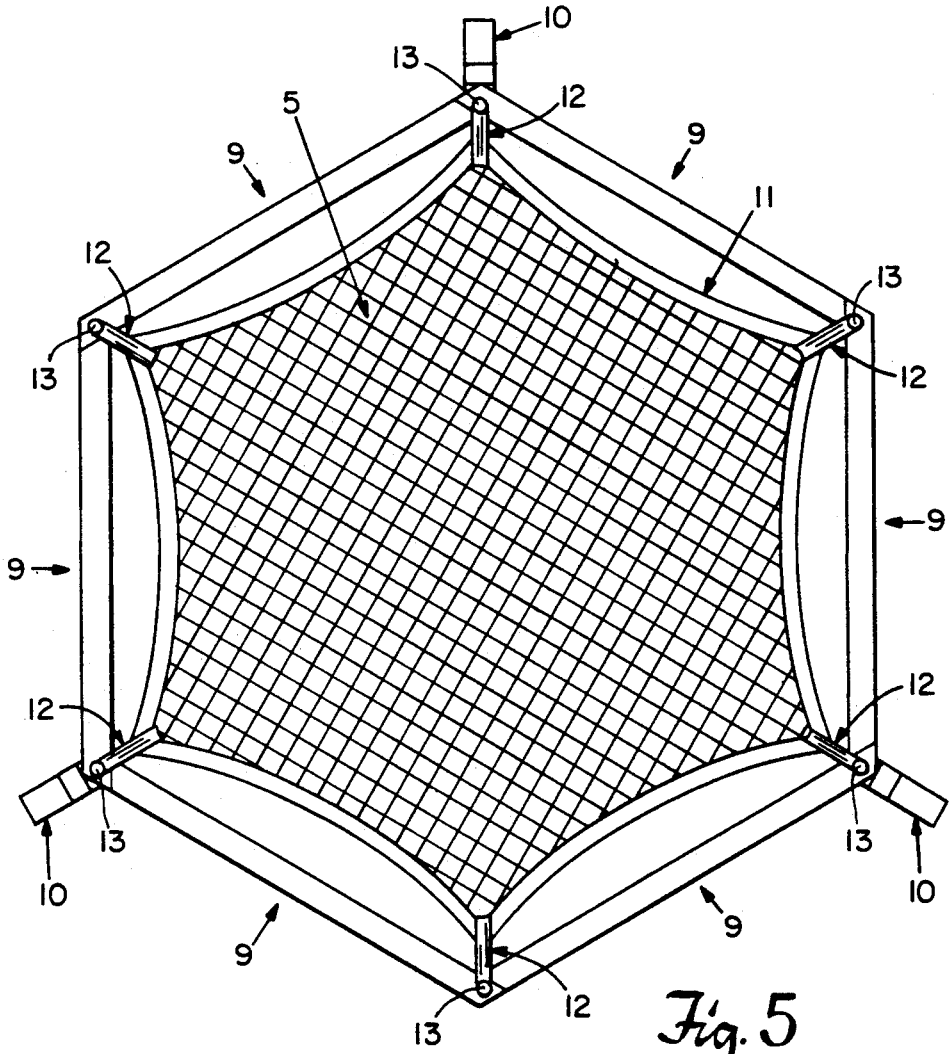
FIG. 5 is top plan view of the trampoline device.

The preferred construction of an easily assembled and disassembled trampoline device 2, as shown in FIG. 5, is comprised of six net frame members 9 lap joined to form a hexagonal configuration, three supporting legs 10 attached to the net frame members 9 at alternate corners of the hexagonal configuration, a net 5, and six resilient devices 12 under tension which create a resiliently-tensioned net 5 when one end is attached to the corners of the net 5 and the other end is stretched and looped over the sides of the heads 19 (see FIG. 8) of the six trampoline device bolts 13 said heads having a concave depression to secure the loop. The positioning of discs flipped by the flipping sticks from the ground and through the air onto the resiliently-tensioned net 5 is the objective of the game. The trampoline device bolts 13 when tightened with a wing nut 17 (see FIG. 8), also hold the net frame members 9 rigid and hold the legs 10 to the net frame members 9.

The net frame members 9 and the legs 10 may be manufactured out of wood, metal, plastic or any other suitable satisfactory material. The net 5 may be manufactured out of polyester mesh or netting or other suitable satisfactory synthetic or natural material. Polyester has the advantage over nylon of not breaking down when exposed to ultraviolet rays. The edges 11 of the net 5 may be protected by binding, edge treatment or other suitable satisfactory material or process. The net 5 and the resilient devices 12 must be sized so that the net 5 is under tension when all resilient devices 12 are looped over the heads 19 of the six trampoline device bolts 13. The resilient devices 12 stretching the net 5 may be made of small neoprene O-rings, stainless steel springs or other suitable satisfactory material. If neoprene O-rings are used, one side is attached to the corner of the net 11 using a cow hitch and the other side is looped over the concave depression in the head 19 of the trampoline device bolts 13. The trampoline device bolts 13 may be made of stainless steel or other suitable satisfactory material.

Figure 6:
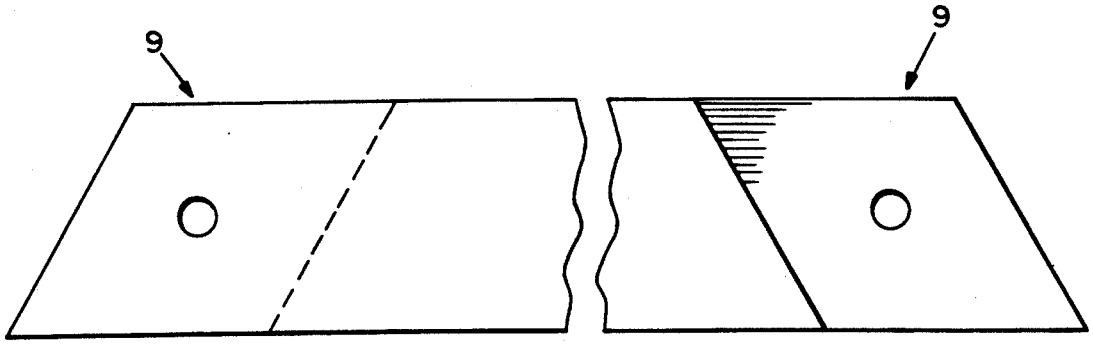
FIG. 6 is a top plan view of one of the six net frame members of the trampoline device.

The preferred construction of the net frame members 9, as shown in FIG. 6, comprises a rectangular configuration approximately ¾" in height, 1½" in width and 22" in length which is cut at 60 degree angles at each end to a height equal to one-half of that of the net frame members 9 so that the six net frame members 9 may be lap joined in a hexagonal configuration. A hole is drilled in each end of the net frame members 9 to receive the trampoline device bolts 13 when the net frame members 9 are lap joined.

Figure 7:
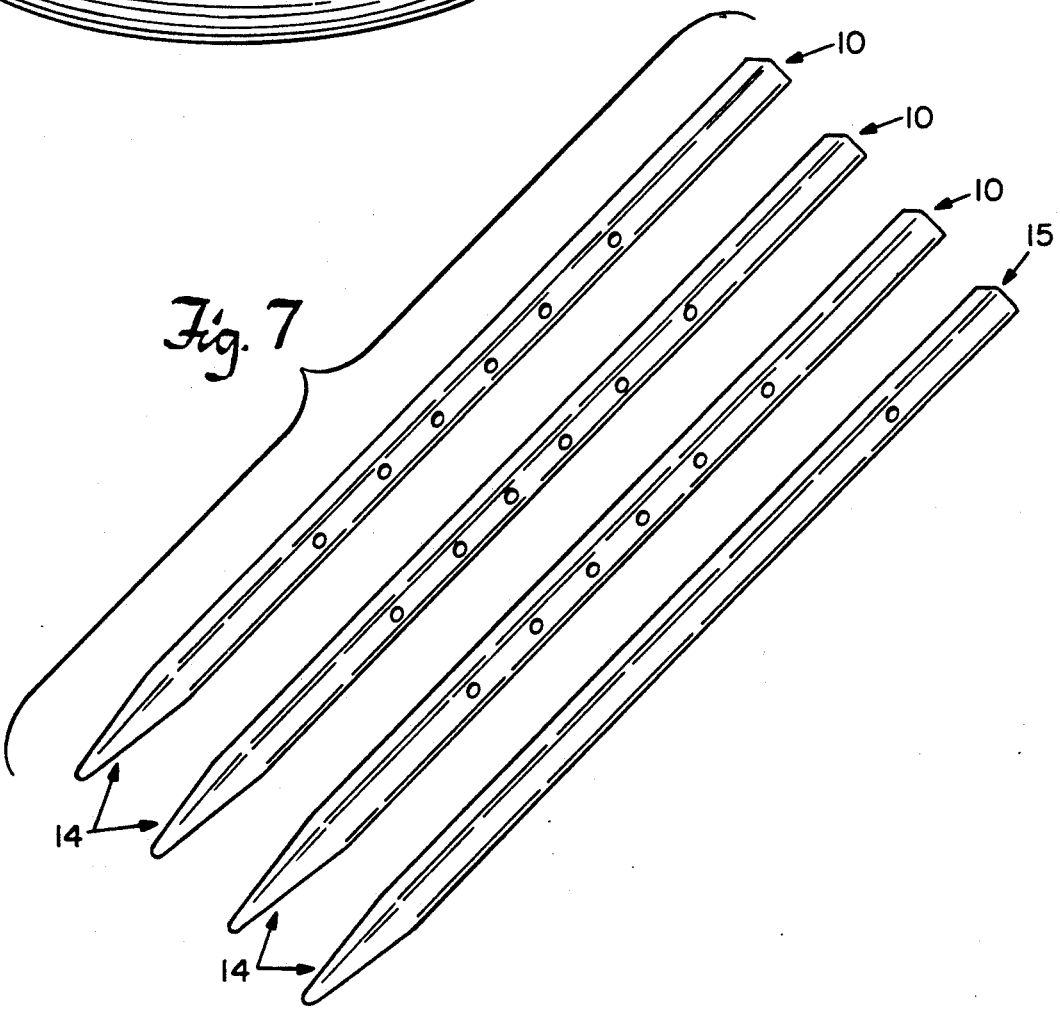
FIG. 7 is a perspective view of the three trampoline device legs and the extension leg used to level the trampoline device on uneven ground.

The preferred construction of the legs 10 for the trampoline device 2, as shown in FIG. 7, consists of three members of rectangular configuration approximately 1" square and approximately 26" in length with a taper 14 at the end which touches the ground. All of the legs have a plurality of holes so that an extension leg may be secured to one of the legs when necessary. The extension leg 15 has one hole drilled for adjusting the trampoline device 2 on sloping ground so that the resiliently-tensioned net 5 always will be positioned in a horizontal position at a distance above the ground A bolt and wing nut or other suitable satisfactory device may be used to attach the extension leg 15 to any of the legs 10 with a plurality of holes in order to compensate for sloping ground. With only three legs 10 touching the ground, this adjustment is easily accomplished.

Figure 8:
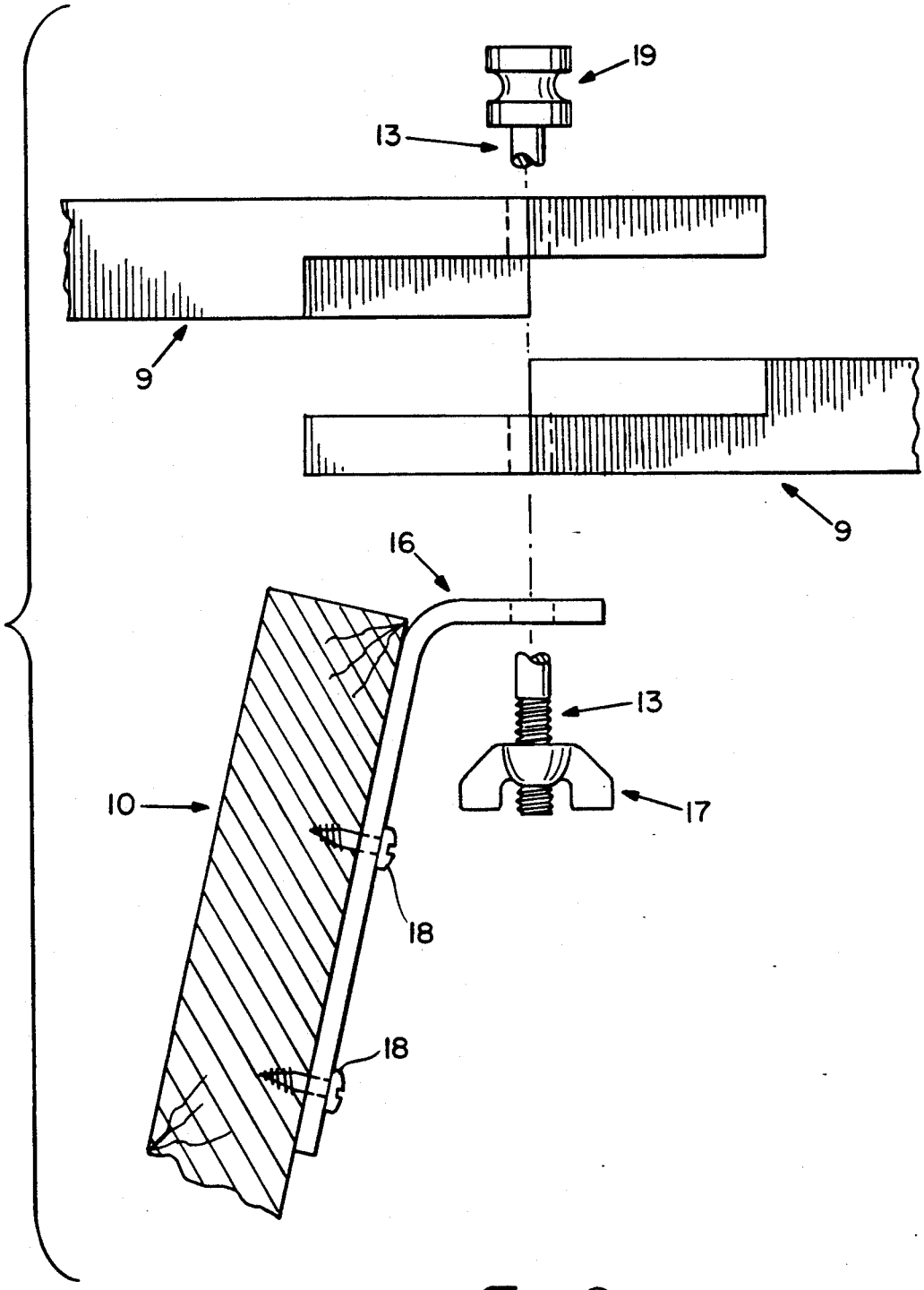
FIG. 8 is a fragmentary view of the corner of the trampoline device and the means of attaching the net frame members, legs and resiliently-tensioned net together.

The means of joining the elements of the trampoline device 2 together, as shown in FIG. 8, include a trampoline device bolt 13 which passes through the trampoline device bolt holes in the net frame members 9 and through a hole in the leg connector 16. The leg connector 16 is angled so that the legs 10 will be slightly splayed to provide greater stability to the trampoline device 2 when the wing nut 17 is screwed tightly to the trampoline device bolt 13. Screws 18 are used to attach the leg connector 16 to the legs 10. The trampoline device bolt 13 has a head 19 with a concave depression cut in its side with said depression designed to secure one end of the resilient devices 12. The leg connector 16 may be made of stainless steel or other suitable satisfactory material.

The trampoline device is easily assembled by lap joining the six net frame members upside down in a hexagonal configuration on the ground, then inserting the six trampoline device bolts through holes in the frame members at the lap joints such that their heads are on the ground and the screw ends stick up through the holes where the frame members are joined, then positioning the three legs with attached leg connectors at alternate corners of the hexagon frame so that the screw ends stick up through the hole in the leg connectors, then tightening the wing nuts on all trampoline device nuts, then turning the assembled frame upside down so that it rests on the three legs, then attaching the net with one end of each of the six resilient connectors attached to each of the six corners of the net and the other ends of the resilient connectors stretched and looped over the concave depressions in the side of the head of the trampoline device bolts thus placing the net in resilient tension. Where necessary the extension leg may be bolted, as appropriate, to the leg with a plurality of holes.

The objective of the competitive game is to be the first player, or in the case of team play, the first team to flip a specified number of discs from the ground and through the air so that the discs are resting on the trampoline device's resiliently-tensioned net. The resilient net often causes the disc to bounce off to the ground when the disc strikes the net with too much force. Skill is required to compensate for unpredictable reactions when the disc meets the resilient net. Also the rules of the game, as described below, allow a player to dislodge an opponents disks from the net.

The basic playing equipment comprises, in addition to the trampoline device, four flipping sticks of different color and eight discs with pairs of the discs colored to match the colors of the flipping sticks.

The basic shot of the game consists of using the flipping stick to flip a disc into the air. This is accomplished by holding the stick with two hands as shown in FIG. 1 and sliding the fork end under the disc. At the beginning of the flipping action, at least one point on the disc must be touching the ground. This is to insure a flipping, rather than a lifting or spooning motion which is prohibited.

Under the rules, the game can be played by two to eight people on a lawn area or the like. Play starts at a point distant from the net mutually decided upon by the players—50 feet is ideal but can be increased to a greater distance where space allows or a more challenging game is desired. Each player uses one flipping stick and one pair of disks of the same color. The first player flips one disc toward the net with the objective of landing it on the net. Each player then follows in consecutive order. The second disc is then flipped by the first player and followed by the other players in the same order as the initial play. After the initial flips, the players may flip only one of his disks of his choice at a time, playing in order until the requisite number of disks are resting on the net.

When from one to three people are playing the game, a point is scored when one player gets both of his disks to rest on the net. When four to eight people play the game, the players are divided into two teams and a point is scored when one team gets three of its disks to rest on the net. Under team play, depending on the number of players, a player may have either one or two discs of the same color to play. In team play, flipping sticks, matching the color of the disc to be played, are shared by members of the same team.

Under the scoring system, the first player or team to score eleven points wins the set. The winner of two sets wins the match.

Part of the strategy of the game is to dislodge an opponent, or opponents, from a scoring position on the net. This is accomplished by flipping a disc resting on the ground underneath the net in a swift upward movement thus jarring an opponents disc off the net and also trying not to dislodge one of your own or a partner's disc if it happens to be resting on the net. A second method is to aim a disc so that it bounces or hits an opponents disc to the ground. There is a penalty if any part of the flipping stick touches any part of the trampoline device.

A player may also flip an opponent's disc which is resting on the ground. This is accomplished by aiming a disc to hit an opponents disc. When this happens the player whose disc hits an opponents disc lying on the ground is allowed an extra shot to flip the opponents disc as far away from the net as possible or as established by ground rules agreed upon by the players at the beginning of the game. If the opponent's disc is not hit it is possible that the players disc may be positioned in a location which will allow the opponent, on his or her next flip, to have an easy opportunity to hit the player's disc. These conditions and other similar situations must be factored into a playing strategy by players of the game.

The manner in which the game apparatus is used is limited only by the ingenuity of players in devising strategies and, if they so choose, their own rules.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, and arrangements of parts may be resorted to without departing from the spirit of the invention, the scope of the novel parts thereof or the scope of the claims.

Having thus described the invention, what is claimed is:

1. A competitive game having rules and a scoring system designed for play by two or more individuals on a lawn area and the like, where the several elements of the game apparatus depend upon and interact with each other, the apparatus comprising, in combination;

a plurality of discs of flying saucer configuration with the flat side tapering to form a rounded edge at the circumference of the circle;

a plurality of flipping sticks comprised of an elongated handle portion and an affixed two-tined fork portion with the tines positioned at a distance from each other which is slightly less than the outside diameter of the discs and with the tines bent near their outer ends at an angle of about 45° so that a player may position the two-tined fork end under a disc where it rests on the ground prior to initiating the flipping action which propels the discs into the air;

an easily assembled and disassembled trampoline device constructed in such a manner as to have a resiliently-tensioned net held horizontally at a distance above the ground, with the positioning of discs flipped by flipping sticks from the ground through the air and onto the resiliently-tensioned net being the objective of the game.

2. The game apparatus of claim 1 wherein said trampoline device includes six net frame members lap-joined to form a hexagonal configuration, three supporting legs attached to the net frame members at alternate corners of the hexagonal configuration, a net, six resilient devices under tension which create a resiliently-tensioned net when one end is attached to the corners of the net and the other is stretched and tensioned and looped over the head of the six trampoline device bolts, said bolts when tightened with a wing nut also hold the net frame members rigid and hold the legs to the net frame members, and an extension leg for adjusting the trampoline device so that the resiliently-tensioned net always will be in a horizontal position.

3. The game apparatus of claim 2 wherein said trampoline device bolts have a concave depression cut in the side of the head to secure one end of the resilient devices.

* * * * *